US011505968B2

(12) United States Patent
Tway

(10) Patent No.: US 11,505,968 B2
(45) Date of Patent: Nov. 22, 2022

(54) SHROUDED PADLOCK

(71) Applicant: Wilson Bohannan Lock Company, Marion, OH (US)

(72) Inventor: William B. Tway, South Salem, NY (US)

(73) Assignee: Wilson Bohannan Lock Company, Marion, OH (US)

( * ) Notice: Subject to any disclaimer, the term of this patent is extended or adjusted under 35 U.S.C. 154(b) by 75 days.

(21) Appl. No.: 17/012,436

(22) Filed: Sep. 4, 2020

(65) Prior Publication Data

US 2021/0062554 A1 Mar. 4, 2021

Related U.S. Application Data

(60) Provisional application No. 62/895,969, filed on Sep. 4, 2019.

(51) Int. Cl.

| | |
|---|---|
| ***E05B 67/04*** | (2006.01) |
| ***E05B 67/38*** | (2006.01) |
| ***E05B 67/06*** | (2006.01) |

(52) U.S. Cl.

CPC ..... *E05B 67/04* (2013.01); *E05B 67/063* (2013.01); *E05B 67/38* (2013.01)

(58) Field of Classification Search

CPC ..... E05B 67/02; E05B 67/04; E05B 67/063; E05B 67/38; E05B 67/383; E05B 2067/386

See application file for complete search history.

(56) References Cited

U.S. PATENT DOCUMENTS

| | | | | |
|---|---|---|---|---|
| 3,572,064 A * | 3/1971 | Berry | E05B 67/38 70/52 |
| 3,751,948 A * | 8/1973 | Klein | E05B 67/38 70/55 |
| 3,754,419 A * | 8/1973 | Taylor | E05B 67/38 70/52 |
| 3,835,675 A * | 9/1974 | Lippisch | E05B 67/02 70/52 |
| 4,107,965 A * | 8/1978 | Miller | E05B 67/38 70/52 |

(Continued)

*Primary Examiner* — Christopher J Boswell
(74) *Attorney, Agent, or Firm* — Nicholson De Vos Webster & Elliott LLP

(57) ABSTRACT

A padlock shroud is described for protecting a padlock. For example, one implementation of a padlock shroud comprises: a shroud body having a chamber with an opening accessible to a padlock body, the opening formed in a lower portion of the shroud body, wherein to engage a padlock with the shroud, the padlock body is inserted into the chamber through the opening, apertures formed through an upper portion of the shroud body and having a spacing substantially equal to a spacing of legs of a shackle to be engaged with the padlock through the apertures, a shackle protector having first and second connection points adjacent to the apertures and extending upward from the upper portion of the shroud body at a length at least substantially equal to a length of the legs of the shackle, and a press pin aperture formed on a side of the shroud body and positioned to allow a press pin to be inserted beneath the padlock body when the padlock body is fully inserted into the chamber.

14 Claims, 4 Drawing Sheets

(56) References Cited

U.S. PATENT DOCUMENTS

| | | | | | |
|---|---|---|---|---|---|
| 4,548,058 | A * | 10/1985 | Bahry | E05B 67/38 | 70/56 |
| 4,689,975 | A * | 9/1987 | Dunphy | E05B 67/38 | 70/52 |
| 4,763,496 | A * | 8/1988 | Evans | E05B 67/38 | 70/52 |
| 5,146,771 | A * | 9/1992 | Loughlin | E05B 67/38 | 70/56 |
| 6,393,876 | B1 * | 5/2002 | Matyko | E05B 67/38 | 70/52 |
| 6,684,668 | B1 * | 2/2004 | Hsueh Lee | E05B 67/38 | 70/52 |
| 7,380,425 | B2 * | 6/2008 | Elliott | E05B 67/38 | 70/52 |
| 10,995,522 | B2 * | 5/2021 | Derman | E05B 67/38 | |

* cited by examiner

SHROUDED PADLOCK

CROSS REFERENCE TO RELATED APPLICATIONS

This application claims the benefit of U.S. Provisional Patent Application Ser. No. 62/895,969, filed on Sep. 4, 2019, all of which is hereby incorporated herein by reference.

BACKGROUND

Field of Invention

This invention relates to a security apparatus for a padlock. More particularly, the invention relates to a shroud to protect a padlock from unauthorized access.

Related Prior Art

Padlocks and other types of security devices are used to prevent access to locations such as rooms and buildings and also to prevent theft of personal items. Certain types of padlocks are opened with a key while others include a locking mechanism based on a unique numerical code. In either case, a shackle is secured within a padlock body by internal locking components which engage with notches in the shackle to the shackle from being withdrawn from the padlock body. Padlocks of this type can be susceptible to unauthorized access using bolt cutters or other devices capable of severing the shackle into two or more pieces, thereby disengaging the padlock from the protected entity.

DETAILED DESCRIPTION

Figure 1:
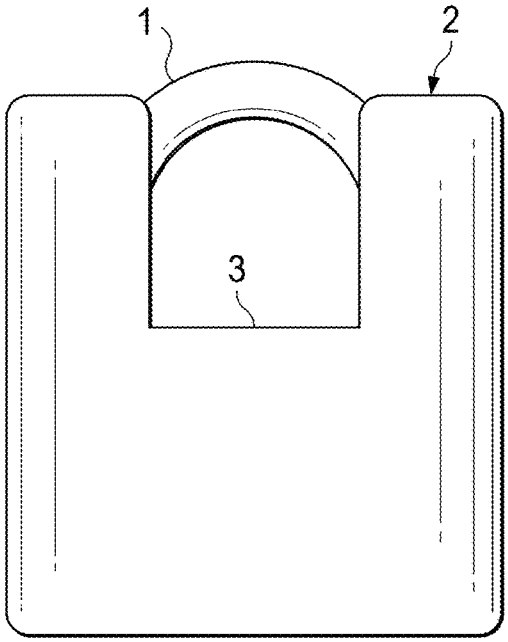
FIG. 1 illustrates a front view of one embodiment of a shroud and padlock with a padlock and shackle completely engaged within the shroud.
Figure 2:
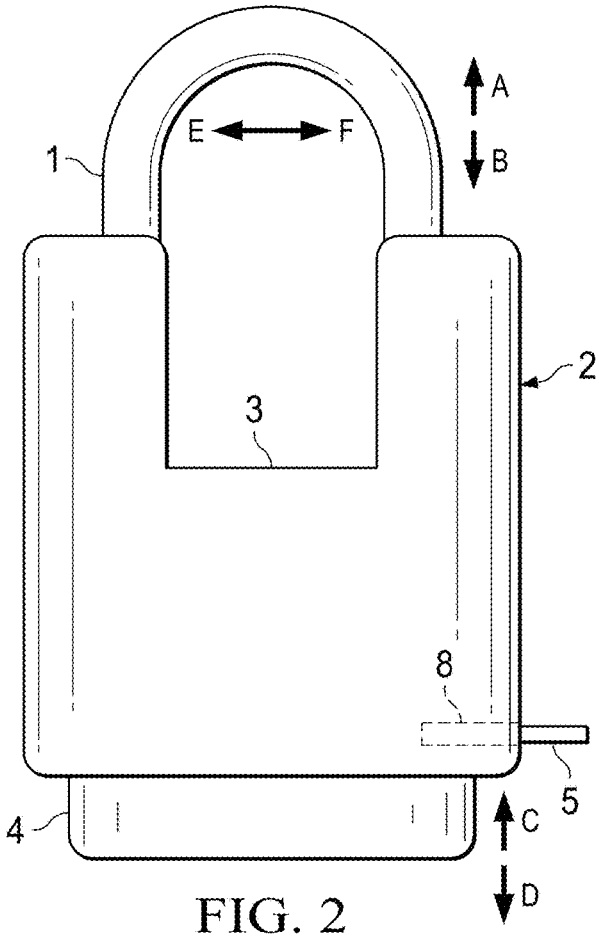
FIG. 2 is a front view showing the padlock halfway into the shroud and the shackle 1 disengaged from the padlock.
Figure 3:
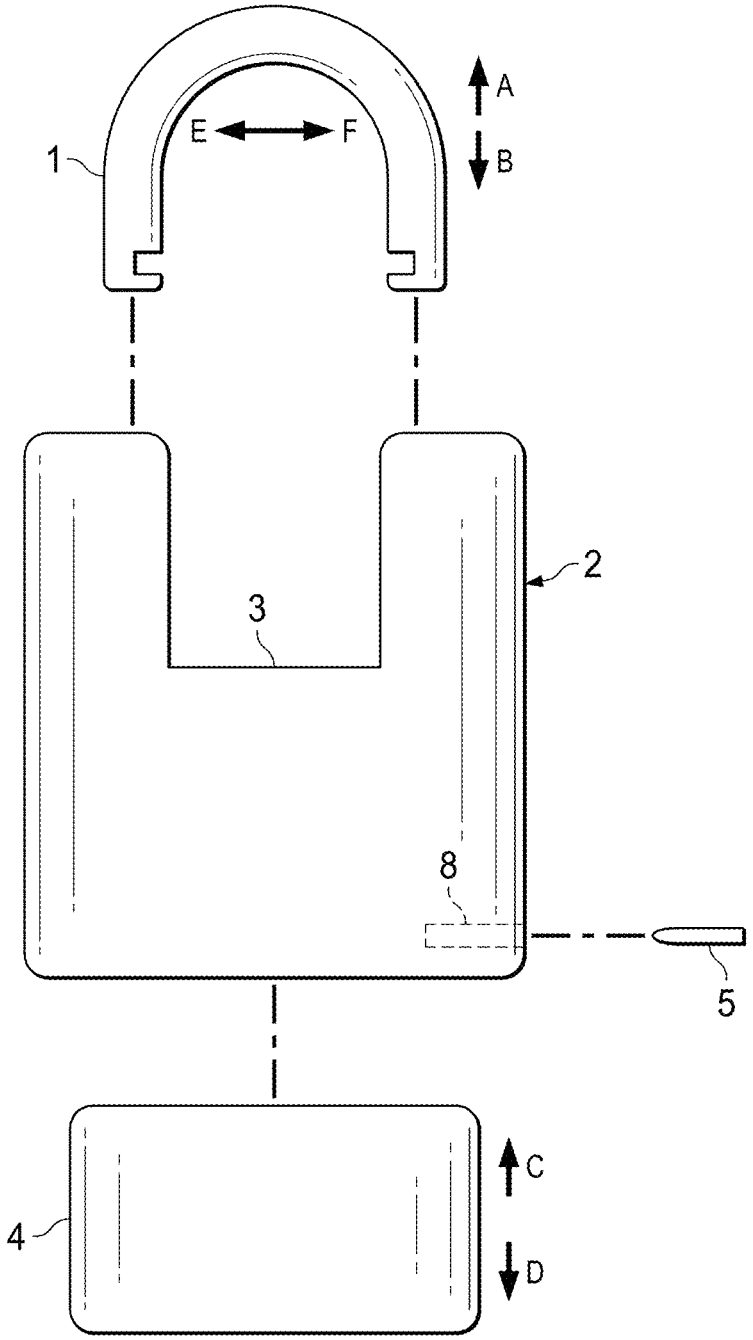
FIG. 3 shows the padlock completely removed from the shroud with the shackle also removed.
Figure 4:
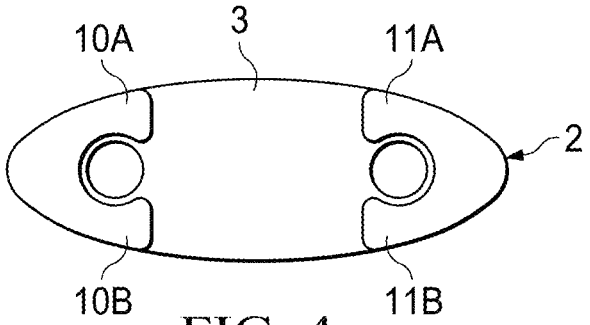
FIG. 4 shows a top view of the shroud without the padlock inserted.
Figure 5:
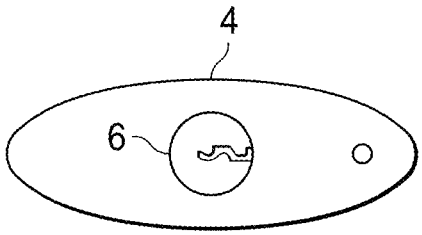
FIG. 5 shows the bottom view of a padlock and keyhole.
Figure 6:
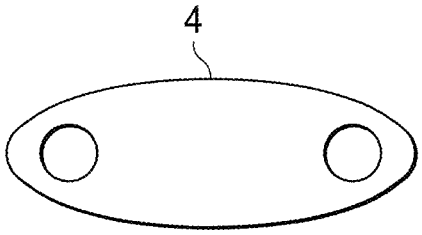
FIG. 6 shows the top view of padlock.
Figure 7:
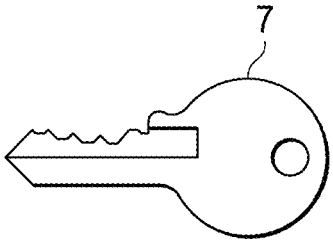
FIG. 7 shows a key to lock and unlock the padlock.
Figure 8:
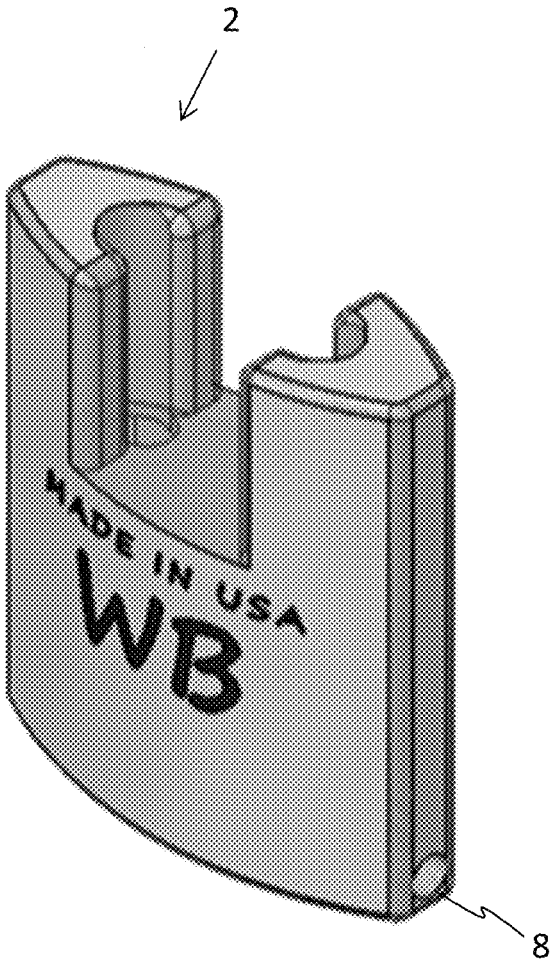
FIG. 8 shows a perspective view of an embodiment of the shroud.

FIG. 1, is a front view of one embodiment of a shrouded padlock with a padlock and shackle 1 completely engaged within the shroud 2. FIG. 2 is a front view showing the padlock 4 halfway into the shroud 2 and the shackle 1 disengaged from the padlock 4. FIG. 3 shows the padlock 4 completely removed from the shroud 2 with shackle 1 also removed. FIG. 4 shows a top view of the shroud 2 without padlock 4 inserted. FIG. 5 shows the bottom view of padlock 4 and keyhole 6. FIG. 6 shows the top view of padlock 4 and FIG. 7 shows key 7 to lock and unlock the padlock 4. FIG. 8 shows a perspective view of an embodiment of the shroud 2.

To allow for clarity in the use of the shroud, below I have described its construction and operation.

The shroud 2 is designed to allow a padlock 4 to be inserted into the shell of the shroud 2 and secured with a roll or press pin 5 inserted through an aperture 8 in the shroud as shown in FIGS. 2-3 and 8. In one implementation, the press pin 5 permanently secures the bottom of the padlock 4 inside the shroud 2.

In one implementation, the shackle 1 is notched on both sides so it can be inserted in either direction. The shackle 1 engages with the padlock 4 and is secured by a locking bolt. As the shackle 1 is completely removable, the shroud 2 has four points (or ears) 10A-B and 11A-B that guard the shackle (e.g., shown surrounding the two holes for the shackle 1 in FIG. 4). In the illustrated embodiment, the top of the shroud 2, where the shackle is inserted, has ears 10A-B and 11A-B on both sides, which protects the shackle 1 against attacks from bolt-cutters. Since the sides, or legs, of the shackle 1 are encased within the ears 10A-B and 11A-B it is impossible to cut the shackle 1 through the ears 10A-B and 11A-B.

The distance E-F between the legs of the shackle is such that a 10 mm or ⅜" High Security Chain can be used. This chain is secured by putting both ends through the shackle then putting the shackle into the shroud 2 and locking it into the padlock locking bolt. Thus, the distance E-F for this particular implementation is greater than or equal to 20 mm (greater than the width of two 10 mm security chain links placed side to side through the shackle). Note, however, that the underlying principles of the invention are not limited to these specific measurements. The chain allows the user more flexibility in securing their property by allowing them to attach the shrouded lock in spaces that might not be accessible due to space, angles, etc.

As the padlock 4 is fully engaged into the shroud 2 and the press pin 5 is engaged, there is a significant space from the bottom of the padlock (bottom of press pin) to the bottom of the shroud in one particular implementation. This is to guard against picking attacks. That is, this space makes it very difficult to insert a "tension tool" which is essential in picking any padlock.

In one embodiment, the padlock can be completely removed from the shroud 2 by drilling out the press-pin 5. A standard padlock 4 can subsequently be inserted back into the shroud 2 and secured by a new press pin 5. Various different materials including metals and non-metals may be used to form the shroud and padlock. In one embodiment, the padlock shroud is formed from a metal or a metal alloy. For example, the shroud body and shackle protector described herein may be formed together from a single metal casting. The shroud/padlock may be formed out of brass, brass plated to look like steel, and hard anodized aluminum. However, these are merely examples; the underlying principles of the invention are not limited to any particular type of material.

In the above detailed description, for the purposes of explanation, numerous specific details were set forth in order to provide a thorough understanding of the present invention. It will be apparent, however, to one skilled in the art that the invention may be practiced without some of these specific details. For example, while a 10 mm or ⅜" High Security Chain was described for one particular implementation, the underlying principles of the invention are not limited to any particular set of dimensions. Moreover, various well known materials, structures and functions were not described in detail in order to avoid obscuring the subject matter of the present invention. Accordingly, the scope and spirit of the invention should be judged in terms of the claims which follow.

What is claimed is:

1. A padlock shroud comprising:

a shroud body having a chamber with an opening accessible to a padlock body, the opening formed in a lower portion of the shroud body, wherein to engage a padlock with the shroud, the padlock body is inserted into the chamber through the opening;

circular apertures formed through an upper portion of the shroud body and having a spacing substantially equal to a spacing of legs of a shackle to be engaged with the padlock through the circular apertures, the circular apertures having diameters minimally larger than a diameter of the legs of the shackle;

a shackle protector having first and second connection points adjacent to the circular apertures and extending upward from the upper portion of the shroud body at a length at least substantially equal to a length of the legs of the shackle, the shackle protector having a curved inner surface to partially surround the legs of the shackle when the legs of the shackle are engaged with the padlock through the circular apertures; and a press pin aperture formed on a side of the shroud body and positioned to allow a press pin to be inserted beneath the padlock body when the padlock body is fully inserted into the chamber.

2. The padlock shroud of claim 1 wherein the shroud body and shackle protector are formed from a metal or a metal alloy.

3. The padlock shroud of claim 2 wherein the shroud body and shackle protector are formed together from a single metal casting.

4. The padlock shroud of claim 1 wherein the shackle protector comprises first and second ears having the curved inner surface which partially surrounds the legs of the shackle when the shackle is fully inserted through the apertures and engaged with the padlock body.

5. The padlock shroud of claim 4 wherein when the shackle is fully inserted through the apertures and engaged with the padlock body, a top of the shackle is at approximately the same distance from the upper portion of the shroud body as a top of the set of ears.

6. The padlock shroud of claim 5 wherein the shackle comprises two legs which are substantially parallel, each leg comprising a notch to engage with a locking bolt within the padlock body.

7. The padlock shroud of claim 1 wherein when the shroud body is longer than the padlock body to provide a spacing between the bottom of the shroud body and the bottom of the padlock body when the padlock body is fully inserted into the chamber.

8. An apparatus comprising:

a padlock comprising a body and a shackle to engage with the body; and a padlock shroud comprising:

a shroud body having a chamber with an opening accessible to a padlock body, the opening formed in a lower portion of the shroud body, wherein to engage a padlock with the shroud, the padlock body is inserted into the chamber through the opening, circular apertures formed through an upper portion of the shroud body and having a spacing substantially equal to a spacing of legs of a shackle to be engaged with the padlock through the circular apertures, the circular apertures having diameters minimally larger than a diameter of the legs of the shackle;

a shackle protector having first and second connection points adjacent to the circular apertures and extending upward from the upper portion of the shroud body at a length at least substantially equal to a length of the legs of the shackle, the shackle protector having a curved inner surface to partially surround the legs of the shackle when the legs of the shackle are engaged with the padlock through the circular apertures; and a press pin aperture formed on a side of the shroud body and positioned to allow a press pin to be inserted beneath the padlock body when the padlock body is fully inserted into the chamber.

9. The apparatus of claim 8 wherein the shroud body and shackle protector are formed from a metal or a metal alloy.

10. The apparatus of claim 9 wherein the shroud body and shackle protector are formed together from a single metal casting.

11. The apparatus of claim 8 wherein the shackle protector comprises first and second ears having the curved inner surface which partially surrounds the legs of the shackle when the shackle is fully inserted through the apertures and engaged with the padlock body.

12. The apparatus of claim 11 wherein when the shackle is fully inserted through the apertures and engaged with the padlock body, a top of the shackle is at approximately the same distance from the upper portion of the shroud body as a top of the set of ears.

13. The apparatus of claim 12 wherein the shackle comprises two legs which are substantially parallel, each leg comprising a notch to engage with a locking bolt within the padlock body.

14. The apparatus of claim 8 wherein when the shroud body is longer than the padlock body to provide a spacing between the bottom of the shroud body and the bottom of the padlock body when the padlock body is fully inserted into the chamber.

* * * * *